US006987351B2

(12) United States Patent
Choo

(10) Patent No.: US 6,987,351 B2
(45) Date of Patent: Jan. 17, 2006

(54) FLAT PANEL FOR USE IN A CATHODE RAY TUBE

(75) Inventor: Kyoung Mun Choo, Kyungki-do (KR)

(73) Assignee: Samsung Corning Co., Ltd., Kyungki-do (KR)

( * ) Notice: Subject to any disclaimer, the term of this patent is extended or adjusted under 35 U.S.C. 154(b) by 169 days.

(21) Appl. No.: 10/632,926

(22) Filed: Aug. 4, 2003

(65) Prior Publication Data

US 2004/0027046 A1 Feb. 12, 2004

(30) Foreign Application Priority Data

Aug. 7, 2002 (KR) ..... 10-2002-0046460

(51) Int. Cl.
*H01J 31/00* (2006.01)

(52) U.S. Cl. ..... 313/477 R; 313/461; 313/479; 313/2.1 R; 313/2.1 A

(58) Field of Classification Search ..... 313/477 R, 313/461, 479; 220/2.1 R, 2.1
See application file for complete search history.

(56) References Cited

U.S. PATENT DOCUMENTS

| | | | | |
|---|---|---|---|---|
| 4,483,452 | A * | 11/1984 | Blanding et al. | 220/2.1 A |
| 4,893,054 | A * | 1/1990 | Kobayashi | 313/477 R |
| 6,417,613 | B1 * | 7/2002 | Kyono | 313/477 R |
| 6,812,631 | B2 * | 11/2004 | Murakami | 313/477 R |
| 2002/0130607 | A1 * | 9/2002 | Jeoung | 313/408 |
| 2003/0214221 | A1 * | 11/2003 | Choo | 313/477 R |

* cited by examiner

*Primary Examiner*—Mariceli Santiago
(74) *Attorney, Agent, or Firm*—Bacon & Thomas, PLLC

(57) ABSTRACT

A flat panel for a cathode ray tube of the present invention includes a faceplate having a useful screen for displaying an image; a skirt portion which extends from a perimeter of the faceplate and has a seal edge; and a blend round portion joining the faceplate with the skirt portion, wherein when an average outer curvature radius R1 and an average inner curvature radius R2 of the faceplate are equal to or greater than 10,000 mm, an overall height H of the faceplate satisfies a following relationship:

$$T1+10 \leq H \leq D \times 0.12$$

where T1 and D are a face center thickness of the faceplate and a diagonal length of the useful screen, respectively.

2 Claims, 1 Drawing Sheet

FLAT PANEL FOR USE IN A CATHODE RAY TUBE

FIELD OF THE INVENTION

The present invention relates to a flat panel for use in a cathode ray tube (CRT); and more particularly, to a slim flat panel having an overall height cut to thereby reduce a total depth of a CRT.

BACKGROUND OF THE INVENTION

As well known, a glass bulb employed in a CRT for use in a color television or a computer monitor includes a panel for displaying an image, a conical funnel portion joined to a rear portion of the panel and a cylindrical neck integrally connected to an apex portion of the conical funnel portion. The panel, the funnel and the neck portion are made of glass, and particularly the panel and the funnel portion are formed with predetermined dimensions and shapes by press-forming a melted glass called a glass gob.

Such a CRT panel is provided with a faceplate for displaying an image, a skirt portion extending backward from a perimeter of the faceplate and having a seal edge on its back end, and a blend round portion (or corner portion) integrally joining the skirt portion to the faceplate. The funnel is divided into a body portion having a seal edge and a yolk portion extending backward from the body portion. The seal edge of the body portion is connected to the seal edge of the skirt portion, and the neck portion is connected to the yolk portion.

Recently, a flat panel tends to be preferred to a conventional spherical panel because of customers' increasing demand for high resolution and large-size screen, thereby rapidly accelerating the replacement of the spherical panel by the flat panel. When compared to a spherical panel, a flat panel offers numerous advantages. For example, the flat panel can reduce image distortion, minimize eye fatigue and provide a wide range of visibility. However, a CRT with a large-size screen increases the total depth of the CRT, i.e., a distance between the faceplate and the rear of the neck portion, thereby occupying large space. Hence, the CRT having a large-size screen is disadvantageous over a flat display such as a plasma display-panel (PDP) and a liquid crystal display (LCD) with a same-size screen in terms of saving space needed for installation thereof.

Therefore, various attempts have been made to reduce the total depth of the CRT as well as to enlarge and flatten the screen thereof. In such attempts, however, a shadow mask and an inner shield become an obstacle to the reduction of the total depth. In a beam index CRT, which eliminates the shadow mask and the inner shield and employs an index stripe and a photo detector, a complete flattening and a slimness of the panel can be achieved. A sheet glass substrate without the skirt portion is used as a flat panel for a small CRT of a size ranging 15~19 inches. However, in case the sheet glass substrate is used as a flat panel for a large CRT of a size of 29 inches or greater, it is difficult to manufacture the sheet glass substrate due to its deformation occurring upon the press-forming thereof and further, the sheet glass substrate is structurally so weak that it does not satisfy UL (Underwriters Laboratories Inc.) standards for implosion proof.

SUMMARY OF THE INVENTION

It is, therefore, an object of the present invention to provide a slim flat panel which has a minimized skirt portion to reduce a total depth of a CRT while satisfying the UL standards for implosion proof.

In accordance with the present invention, there is provided a flat panel for a cathode ray tube, including: a faceplate having a useful screen for displaying an image; a skirt portion which extends from a perimeter of the faceplate and has a seal edge; and a blend round portion joining the faceplate with the skirt portion, wherein when an average outer curvature radius R1 and an average inner curvature radius R2 of the faceplate are equal to or greater than 10,000 mm, an overall height H of the faceplate satisfies a following relationship: $T1+10 \leqq H \leqq D \times 0.12$ where T1 and D are a face center thickness of the faceplate and a diagonal length of the useful screen, respectively.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
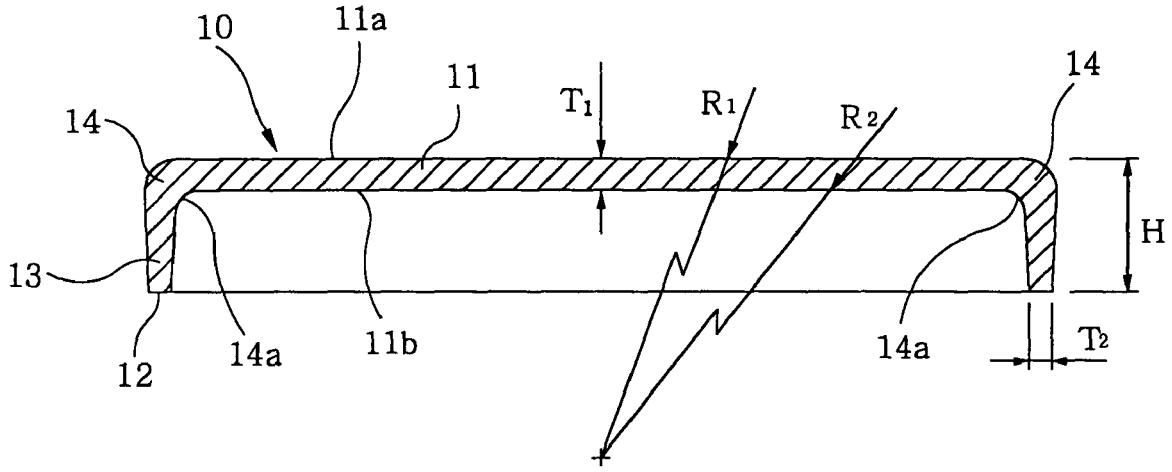
FIG. 1 illustrates a diagonal cross sectional view of a flat panel in accordance with a preferred embodiment of the present invention.

A flat panel for use in a cathode ray tube in accordance with preferred embodiments of the present invention will now be described with reference to accompanying drawings. And like parts will be represented with like reference numerals.

Referring to FIG. 1, there is illustrated a diagonal cross sectional view of a slim flat panel in accordance with a preferred embodiment of the present invention. The slim flat panel 10 includes a faceplate 11 for displaying an image, a skirt portion 13 extending backward from a perimeter of the faceplate 11 and having a seal edge on its back end, and a blend round portion 14 for joining the faceplate 11 with the skirt portion 13.

Figure 2:
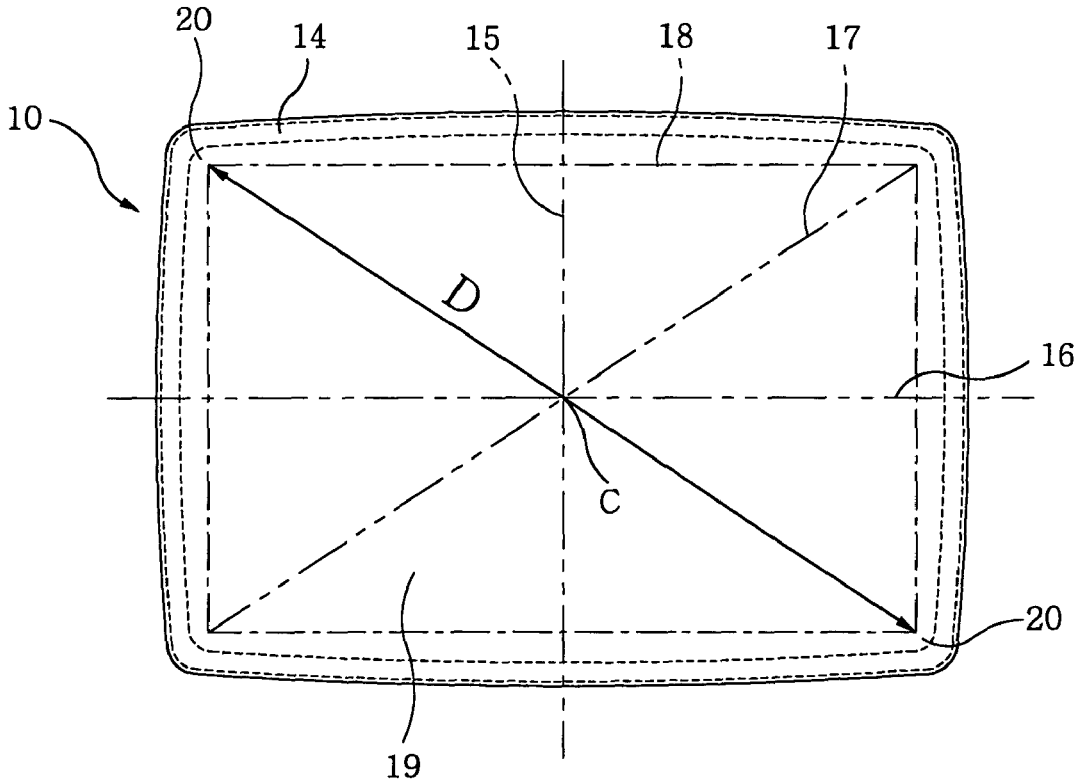
FIG. 2 presents a top view of the flat panel.

Referring to FIG. 2, there is illustrated a top view of the slim flat panel 10. The slim flat panel 10 has a shape of rectangle having a short axis 15 and a long axis 16. The faceplate 11 is provided with a central portion 19 serving as a useful screen 18 (or effective screen) for displaying an image, and a peripheral portion 20 surrounding the central portion 19. Reference D represents a length of a diagonal 17 of the useful screen 18.

As shown in FIG. 2, reference C represents a center of the useful screen 18, i.e., an intersection of two diagonals 17, through which an axis of a glass bulb and an axis of a neck portion pass. In FIG. 1, reference T1 represents a center face thickness, i.e., a thickness of the faceplate 11 measured at the center C of the useful screen 18; T2, a seal edge thickness, i.e., a thickness of the seal edge 12; H, an overall height of the flat panel, i.e., a distance between a plane tangent to the seal edge 12 and a plane tangent to the center C on an outer surface 11*a* of the faceplate 11; R1, an average outer curvature radius, i.e., an average of outer curvature radii passing the center C on the outer surface 11*a* in predetermined directions; and R2, an average inner curvature radius, i.e., an average of inner curvature radii passing the center C on an inner surface 11*b* in predetermined directions.

The slim flat panel 10 in accordance with the preferred embodiment is designed to satisfy press characteristics of press-forming and UL standards for implosion proof with a minimized overall height. In a case where the average outer curvature radius R1 is equal to or greater than 10,000 mm and the average inner curvature radius R2 is equal to or greater than 10,000 mm, the overall height H satisfies a following equation:

$$T1+10 \leqq H \leqq D \times 0.12 \quad \text{Eq. 1}$$

where T1 and D represent the center face thickness and the diagonal length, respectively.

In order to render the flat panel 10 slim, it is preferable to flatten the inner surface 11*b* as well as the outer surface 11*a*. In case the inner surface 11*b* is flattened, the smaller an inside blend radius 14*a* of the blend round portion 14, the shorter is a length of the blend round portion 14 connected with the skirt portion 13. However, in that case, the formability in press-forming of the panel is deteriorated and thermal stress concentration at the blend round portion 14 is increased, thereby resulting in deformation and failure of the flat panel 10. Therefore, for the maintenance of the formability and the prevention of the increased thermal stress concentration at the blend round portion 14, the inside blend radius 14*a* should be equal to or greater than 5 mm.

A mold set for press-forming the flat panel 10 includes a bottom mold, a middle mold (referred to as a shell) for forming the seal edge 12 and the skirt portion 13, which is joined with an upper portion of the bottom mold, and an upper mold (referred to as a plunger) which forms an inner surface of the flat panel 10 by pressing a glass gob loaded in a cavity of the bottom mold.

The upper mold, which is attached to a ram of a press, ascends and descends by the activation of the ram, and presses the glass gob in the bottom mold to form the flat panel 10. After the flat panel 10 is formed, in order to open the upper mold without scratches on an inner surface of the skirt portion 13, a taper surface, which has a predetermined angle, should be provided to the inner surface of the skirt portion 13. The taper surface is set to be at least 5 mm in length. Therefore, the skirt portion 13 should have a length which is at least 10 mm longer than T1 for the press-forming thereof in consideration of the size of the blend round portion and the length of the taper surface. In addition, the overall height of the flat panel 10 should be equal to or less than D×0.12.

UL standards for implosion proof are intended for guaranteeing safety and reliability of a CRT through impact tests. The impact test is performed as follows: A predetermined position on the panel is impacted by a spherical or missile-shaped object with an energy of 7~20 joules (J). Then, mass of glass fragments broken away from the panel or a funnel portion is measured to determine whether it is less than a reference value. And if the mass is less than the reference value, the CRT passes the impact test.

When a glass bulb is evacuated, the glass bulb experiences a compressive stress and a tensile stress due to a pressure difference between the inside and the outside of the glass bulb. Since a glass has a weakness against a tensile stress, a breakage or an implosion is likely to occur at the portion of the glass bulb under the tensile stress. When an impact or a thermal stress is applied to the panel, cracks start to develop at the blend round portion subject to a maximum tensile stress and propagate therefrom, and then the glass bulb is finally imploded. Thus, in designing the panel, the overall height H, the center face thickness T1 and the seal edge thickness T2 are considered as critical factors to moderate or reduce the tensile stress of the glass bulb. In general, the bulb is designed in such a manner that the panel has an allowable maximum vacuum stress of about 10 MPa considering a safety factor, and particularly a connection portion where the seal edge of the panel is joined with the seal edge of a funnel portion by using a crystalline powder glass called frit, has an allowable maximum vacuum tensile stress of about 8 MPa considering a stress due to thermal expansion coefficient differences between the panel and the funnel, and an application of the frit.

Further, the center face thickness T1 and the seal edge thickness T2 meet following equations, respectively so that the flat panel 10 can have an allowable tensile satisfying UL standards for implosion proof:

$$D \times 0.02 \leqq T1 \leqq D \times 0.037 \quad \text{Eq. 2}$$

$$D \times 0.014 \leqq T2 \leqq D \times 0.026 \quad \text{Eq. 3}$$

Experiment

In order to design a flat panel satisfying Eqs. 2 and 3, a plural number of flat panels were manufactured in a manner that two factors among the center face thickness T1, the seal edge thickness T2 and the overall height H were fixed while the other one was varied. Then, variations of the tensile stresses of the flat panels depending on the change of the center face thickness T1, the seal edge thickness T2 or the overall height H were observed through Experiments 1 to 3. In Experiments 1 to 3, the tensile stresses of faceplates were measured at intersections of the perimeter of the useful screen 18 and the short axis 15 or the long axis 16 where maximum tensile stress occurs. The tensile stresses of seal edges were measured at center portions of horizontal side and vertical side of a glass bulb, wherein the center portions were disposed on a connection portion between a panel and a funnel. Moreover, the tensile stresses were measured by using a photoelastic stress gauge in accordance with a direct method (Senarmont method) defined in Japanese Industrial Standards (JIS)-S2305.

Experiment 1

In Experiment 1, flat panels were made by varying the overall height H while keeping the center face thickness T1 and the seal edge thickness T2 fixed. Table 1 indicates relationships between the overall height (mm) and the tensile stress (MPa). The flat panels in Experiment 1 were for a television set of 32-inch size, a useful screen with an aspect ratio of 16:9. The diagonal length D was 760 mm; the average outer curvature radius R1 and the average inner curvature radius R2 were equal to or greater than 10,000 mm; the center face thickness T1 was 21 mm; and the seal edge thickness T2 was 15 mm.

TABLE 1

| | | | H = 31 mm | H = 50 mm | H = 52 mm | H = 54 mm | H = 56 mm |
|---|---|---|---|---|---|---|---|
| Tensile stress (MPa) | face-plate | short axis | 3.54 | 5.07 | 5.23 | 5.39 | 5.54 |
| | | long axis | 4.79 | 6.02 | 6.12 | 6.22 | 6.31 |
| | seal edge | vertical side | 10.14 | 10.18 | 10.09 | 9.98 | 9.87 |
| | | horizontal side | 10.26 | 9.91 | 9.76 | 9.60 | 9.43 |

As can be seen from Table 1, the tensile stresses in faceplate 11 are less than 10 MPa when the inner and outer surfaces 11*a*, 11*b* of the faceplate 11 are flattened and the overall height H is varied while the center face thickness T1 and the seal edge thickness T2 are maintained at 21 mm and 15 mm, respectively. However, the maximum tensile stress in the seal edge 12 is greater than the allowable tensile stress and thus the seal edge thickness T2 needs to be increased in order to reduce the maximum tensile stress therein. For example, in case the overall height H is 56 mm, the maximum stress in the faceplate 11 becomes about 6 MPa, i.e., less than the allowable tensile stress. However, in case the overall height H is 31 mm, the seal edge thickness T2 needs to be increased to reduce the tensile stress in the seal edge so that the flat panel can satisfy UL standards for implosion proof. It can also be noted from Table 1 that as the overall height H increases without any change of the center face thickness T1 and the seal edge thickness T2, the tensile stress in the seal edge 12 decreases slightly whereas the tensile stress in the faceplate 11 increases.

Experiment 2

In Experiment 2, flat panels were made by varying the seal edge thickness T2 while keeping the center face thickness T1 and the overall height H fixed. Table 2 indicates relationships between the seal edge thickness T2 (mm) and the tensile stress (MPa). The flat panels in Experiment 2 were for a television set of 32-inch size, a useful screen with an aspect ratio of 16:9. The diagonal length D was 760 mm; the average outer curvature radius R1 and the average inner curvature radius R2 were equal to or greater than 10,000 mm; the center face thickness T1 was 21 mm; and the overall height H was 50 mm.

TABLE 2

| | | | T2 = 13 mm | T2 = 15 mm | T2 = 17 mm | T2 = 19 mm |
|---|---|---|---|---|---|---|
| Tensile stress (MPa) | face-plate seal edge | Short axis | 4.82 | 5.07 | 5.25 | 5.39 |
| | | Long axis | 5.80 | 6.02 | 6.18 | 6.29 |
| | | vertical side | 12.24 | 10.18 | 8.78 | 7.79 |
| | | horizontal side | 11.73 | 9.91 | 8.65 | 7.76 |

It can be seen from Table 2 that as the face center thickness T1 increases without any change of the seal edge thickness T2 and the overall height H, the tensile stress in the seal edge 12 decreases sharply whereas the tensile stress in the faceplate 11 increases slowly. Further, when the face center thickness T1 is 21 mm and the overall height H is 50 mm, the seal edge thickness T2 needs to be about 19 mm or more so that the flat panel 10 can satisfy UL standards for implosion proof.

Experiment 3

In Experiment 3, flat panels were made by varying the center face thickness T1 while keeping the seal edge thickness T2 and the overall height H fixed. Table 3 shows relationships between the center face thickness T1 (mm) and the tensile stress (MPa). The flat panels in Experiment 3 were for a television set of 32-inch size, a useful screen with an aspect ratio of 16:9. The diagonal length D was 760 mm; the average outer curvature radius R1 and the average inner curvature radius R2 were equal to or greater than 10,000 mm; the seal edge thickness T2 was 15 mm; and the overall height H was 50 mm.

TABLE 3

| | | | T1 = 15 mm | T1 = 17 mm | T1 = 19 mm | T1 = 21 mm |
|---|---|---|---|---|---|---|
| Tensile stress (MPa) | face-plate seal edge | short axis | 18.17 | 11.99 | 7.86 | 5.07 |
| | | long axis | 16.98 | 12.02 | 8.52 | 6.02 |
| | | vertical side | 15.12 | 13.44 | 11.78 | 10.18 |
| | | horizontal side | 12.43 | 11.74 | 10.88 | 9.91 |

It can be noted from Table 3 that the tensile stresses in the faceplate 11 and the seal edge 12 sharply decrease as the center face thickness T1 increases. Moreover, Table 3 indicates that the tensile stress in the faceplate 11 is less than the allowable tensile stress when the center face thickness T1 is 19 mm or greater.

Experiments 1 to 3 apparently show that the center face thickness T1, the seal edge thickness T2 and the overall height H are critical factors affecting the tensile stress of the glass bulb, and that they should satisfy Eqs. 1 to 3 when a slim flat panel with the overall height reduced is designed. In accordance with the present invention, it is possible to obtain a flat panel which not only has a reduced overall height H but also satisfies press forming characteristics and UL standards for implosion proof.

While the invention has been shown and described with respect to the preferred embodiments, it will be understood by those skilled in the art that various changes and modifications may be made without departing from the spirit and scope of the invention as defined in the following claims.

What is claimed is:

1. A flat panel for a cathode ray tube, comprising:

a faceplate having a useful screen for displaying images;

a skirt portion which extends from a perimeter of the faceplate and has a seal edge; and a blend round portion joining the faceplate with the skirt portion, wherein when an average outer curvature radius R1 and an average inner curvature radius R2 of the faceplate are equal to or greater than 10,000 mm and an overall height H of the faceplate satisfies a following relationship:

$$T1+10(\text{mm}) \leqq H \leqq D \times 0.12$$

where T1 and D are a face center thickness of the faceplate and a diagonal length of the useful screen, respectively.

2. The flat panel of claim 1, wherein the face center thickness T1 and a seal edge thickness T2 satisfy following relationships respectively so that the flat panel has an allowable tensile stress satisfying UL standards for implosion proof:

$$D \times 0.02 \leqq T1 \leqq D \times 0.037$$

$$D \times 0.014 \leqq T2 \leqq D \times 0.026.$$

* * * * *